United States Patent [19]

Barry et al.

[11] 3,957,118

[45] May 18, 1976

[54] CABLE SYSTEM FOR USE IN A PIPE STRING AND METHOD FOR INSTALLING AND USING THE SAME

[75] Inventors: Adelbert Barry; Leon H. Robinson; Jerry M. Speers, all of Houston, Tex.

[73] Assignee: Exxon Production Research Company, Houston, Tex.

[22] Filed: Sept. 18, 1974

[21] Appl. No.: 507,020

[52] U.S. Cl. ..... 166/315; 166/65 R; 174/47; 188/65.1; 242/47.5; 339/91 R; 339/117 R

[51] Int. Cl.[2] ..... E21B 7/00; E21B 47/12

[58] Field of Search ..... 174/47, 69, 70 R; 166/65 R, 65 M, 66, 315; 175/40, 50, 57, 65, 104, 315, 320; 188/65.1; 242/47.5, 129.8, 147 R, 149, 156; 339/15, 16 R, 16 C

[56] References Cited

UNITED STATES PATENTS

| | | | |
|---|---|---|---|
| 1,107,934 | 8/1914 | Hagan | 188/65.1 |
| 1,844,511 | 2/1932 | Kiffe | 242/47.5 |
| 2,351,943 | 6/1944 | Ebbers et al. | 242/47.5 X |
| 3,729,068 | 4/1973 | Fuller | 188/65.1 |
| 3,807,502 | 4/1974 | Heilhecker et al. | 166/65 R X |
| 3,825,078 | 7/1974 | Heilhecker et al. | 175/104 X |
| 3,825,079 | 7/1974 | Heilhecker | 175/104 X |

*Primary Examiner*—Laramie E. Askin
*Attorney, Agent, or Firm*—Robert L. Graham

[57] ABSTRACT

A cable system for wellbore telemetry includes a cable anchored at a subsurface location in a rotary drill string, guide assemblies for maintaining the cable in a looped configuration, and a cable gripping device for maintaining a portion of the cable in tension. Preferably the cable is provided with a novel releasable connector and latch assembly which (1) permits the cable to be electrically connected to a subsurface instrument and anchored to the drill string, (2) permits the cable to be maintained in tension, and (3) is releasable by manipulation of the cable at the surface.

14 Claims, 7 Drawing Figures

CABLE SYSTEM FOR USE IN A PIPE STRING AND METHOD FOR INSTALLING AND USING THE SAME

BACKGROUND OF THE INVENTION

1. Field of the Invention

This invention relates to an improved method and apparatus for performing wellbore telemetry operations. In one aspect, it relates to a cable system for maintaining an electric circuit between a subsurface location and the surface. In another aspect, the invention relates to a self engageable and disengageable connector.

2. Description of the Prior Art

In the drilling of oil wells, gas wells, and similar boreholes, it frequently is desirable to transmit electric energy between subsurface and surface locations. One application where electrical transmission has received considerable attention in recent years is in wellbore telemetry systems designed to sense, transmit, and receive information indicative of a subsurface condition. This operation has become known in the art as "logging while drilling".

A major problem associated with wellbore telemetry systems has been that of providing reliable means for transmitting an electric signal between the subsurface and surface locations. This problem can best be appreciated by considering the manner in which rotary drilling operations are normally performed. In conventional rotary drilling, a borehole is advanced by rotating a drilling string provided with a drill bit at its lower end. Lengths of drill pipe, usually about 30 feet long, are added to the drill string, one at a time, as the borehole is advanced in increments. In adapting an electric telemetry system to rotary drilling equipment, the means for transmitting the electric signal through the drill string must be such to permit the connection of additional pipe lengths to the drill string as the borehole is advanced.

An early approach to the problem involved the use of continuous electric cable which was adapted to be lowered inside the drill string and to make contact with a subsurface terminal. This technique, however, required withdrawing the cable from the drill string each time a pipe length was added to the drill string. A more recent approach involves the use of special drill pipe. Each pipe section of the special pipe is provided with an electric conductor having connectors at its opposite ends. Electric continuity is maintained across the junction of two pipe sections by connectors of one section contacting a connector on the adjacent pipe section (see U.S. Pat. Nos. 3,518,608 and 3,518,609). Disadvantages of this system include the high cost of the special pipe sections, the need for a large number of electric connections (one at each joint), and the difficulty of maintaining insulation of the electric connectors at each joint.

Still another approach involves the use of cable sections mounted in each pipe section (See U.S. Pat. No. 2,748,358). The cable sections are connected together as pipe sections are added to the drill string. Each cable section is normally made slightly longer than its associated pipe section, with the result that a small amount of slack is present in the conductor string at all times. Drilling fluid flowing through the drill string exerts a fluid drag on the loose cable which tends to damage the connectors or snarl the cable.

A more recent development in cable systems for wellbore telemetry operations is described in U.S. Pat. No. 3,825,078 on "Method of Mounting and Maintaining an Electric Conductor in a Drill String". The cable system disclosed in this patent employs a looped cable which permits the cable string to be extended as the drill string is lengthened. Experience with this system has indicated that the overlapped cable sometimes becomes entangled as a result of pipe rotation or fluid flow in the pipe string.

SUMMARY OF THE INVENTION

The objects of the present invention are to provide (1) an improved telemetry system for maintaining electrical continuity between a subsurface and surface location within a rotary drill string, and (2) an improved connector usable in telemetry operations. In one aspect, the invention contemplates an improved method and apparatus for maintaining a cable system in a well. The cable extends from a subsurface location around upper and lower guide assemblies and to the surface. The guide assemblies maintain the cable in overlapped configuration and thereby store excess length of cable in the drill string. The cable system thus permits the cable to be lengthened as the drill string is lengthened.

A novel aspect of the present invention resides in the provision of a cable gripping device on one of the guide assemblies. The gripping device prevents cable slippage and thereby retains a portion of the cable in tension. It has been found that cable entanglement can be minimized if the cable portion which extends from the subsurface location to the upper guide assembly is maintained in tension.

The method involves placing an electric cable within a pipe string to extend from a subsurface location substantially to the surface, arranging the cable about upper and lower guide assemblies to provide the cable with an overlapped configuration, and maintaining the cable portion between the subsurface location and the upper guide assembly in tension. As the drilling operations proceed, the drill string is lengthened. The overlapped conductor provides stored cable which can be fed upwardly through individual pipe sections added to the pipe string. However, the lower portion of the cable is maintained in tension throughout the operation.

The telemetry apparatus includes a cable anchored at a subsurface location within a drill string and extending therefrom to an upper guide assembly, from the upper guide assembly to a lower guide assembly, and from the lower guide assembly to the surface. The upper guide assembly includes a conductor gripping device for maintaining tension in the cable which extends from the cable anchor to the upper guide assembly.

The invention also contemplates an improved self-engaging and disengaging electric connector and latch useful in a variety of drilling operations including wellbore telemetry. The connector includes an enclosed contact and spring loaded latched. The connector mounted at the lower end of an electric cable can be anchored and electrically connected to a remote tool and released therefrom by cable manipulation at the control station, e.g. surface.

DESCRIPTION OF THE PREFERRED EMBODMENTS

Figure 1:
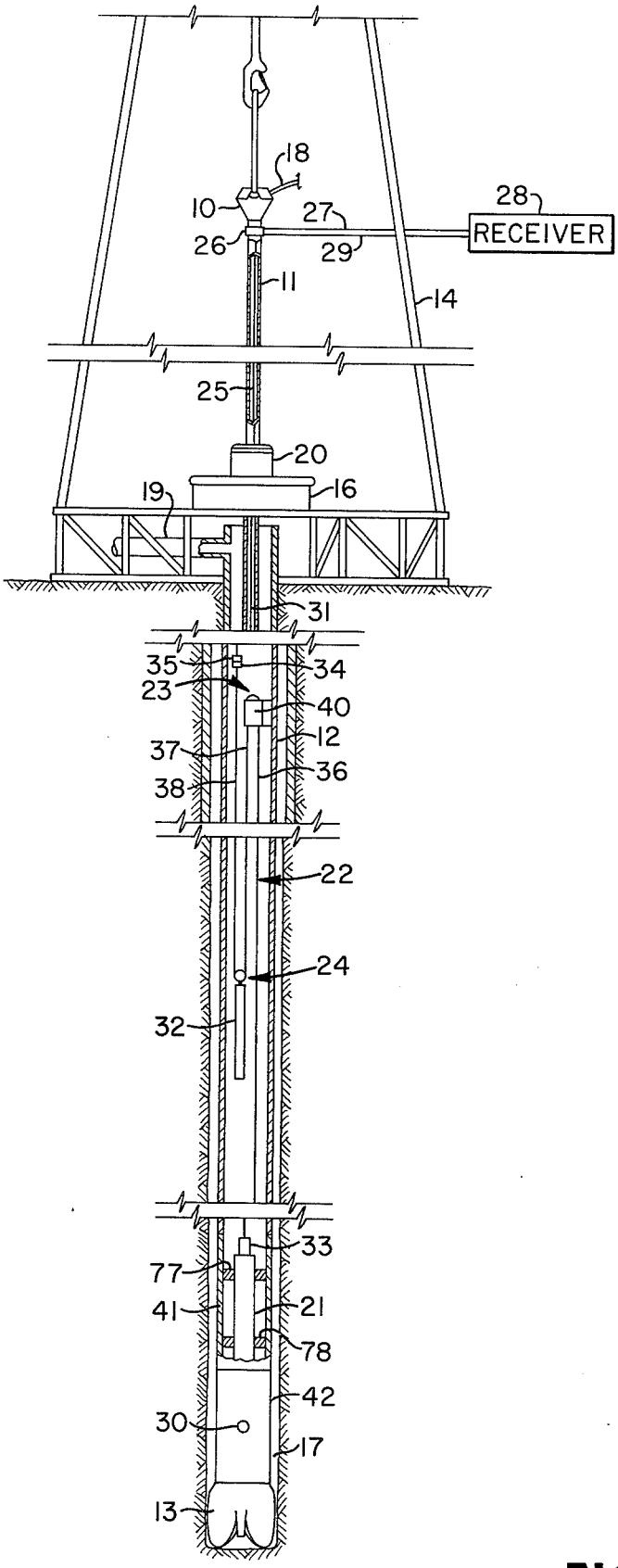
FIG. 1 is a schematic view of well drilling equipment provided with an electric cable for transmitting an electric signal between a subsurface location and the surface.

Conventional rotary drilling equipment, as schematically illustrated in FIG. 1, includes swivel 10, kelly 11, tubular drill string 12, and bit 13. These components, connected in the manner illustrated, are suspended from the drilling derrick 14 by means of rig hoisting equipment. The kelly 11 passes through rotary table 16 and connects to the upper end of the drill string 12. The term "drill string" as used herein refers to the column of tubular pipe between the bit 13 and the kelly 11; and the term "pipe string" refers to the complete pipe column including the kelly 11. The major portion of the drill string 12 normally is composed of drill pipe with a lower portion composed of drill collars. The drill string 12 consists of individual pipe sections, either drill pipe or drill collars, connected together in end-to-end relation.

The borehole 17 is advanced by rotatig rotating drill string 12 and bit 13 while at the same time drilling fluid is pumped through the drill string 12 and up the borehole annulus. The drilling fluid is delivered to swivel 10 through a hose (not shown) attached to hose connection 18 and is returned to the surface fluid system through pipe 19. A kelly bushing 20 couples the rotary table 16 to the kelly 11 and provides means for transmitting power from the rotary table 16 to the drill string 12 and bit 13. It should be noted that the use of a power swivel eliminates the need for the kelly and rotary table. The present invention may also be used in systems which employ a power swivel in lieu of a kelly and rotary table; for purposes of illustration, however, the present invention is described in connection with the kelly and rotary table arrangement.

As mentioned previously, it frequently is desirable to monitor a subsurface drilling condition during drilling operations. This requires measuring a physical condition at the subsurface location, transmitting this data as an electric signal to the surface, and reducing the signal to useful form. Typical situations where telemetry is applicable in drilling operations include drilling through abnormal pressure zones, drilling through zones where hole deviation is likely to be a problem, directional drilling, exploratory drilling, and the like.

Although the present invention may be employed in almost any drilling operation wherein an electric conductor is used in tubular pipe to transmit electric energy between a subsurface and surface location, it finds particularly advantageous application in a wellbore telemetry system such as that illustrated in FIG. 1 which comprises an instrument 21, cable 22, and receiver 28. The term "cable" as used herein in connection with telemetry refers to any size electric conductor. Such cables incude insulated single-conductor cable or multi-conductor cable. Wellbore telemetry cable preferably is armored with wire or bands.

The instrument 21 capable of measuring a subsurface condition and generating an electric signal indicative or representative of that condition is mounted above bit 13 in the drill string 12. A variety of devices capable of sensing a physical condition are available. These include transducers for measuring pressure, temperature, strain, and the like; instruments for measuring mud properties such as electrical resistivity, density or gas content; surveying instruments for measuring hole deviation; and logging instruments for measuring resistivity or other properties of subsurface formations. The instrument 21 may be powered by batteries or by energy transmitted through cable 22. Alternatively, a subsurface generator driven by fluid flowing through the drill string 12 may be used to power instrument 21.

The present invention in one aspect is concerned with installing and maintaining the electric cable 22 within the pipe string 12 during drilling operations. The energy transmitted through cable 22 may be a signal generated by the subsurface instrument 21 and transmitted to the receiver 28 at the surface. Alternatively, the energy may be electric power transmitted from the surface to actuate or drive a subsurface instrument or motor. Also, energy may be transmitted down the cable 22 to power the instrument 21, and simultaneously intelligence may be transmitted up the same conductor.

In telemetry operations, it is preferred that the energy being transmitted be in the form of a pulsating signal. Information can be transmitted by varying the number, amplitude, width or spacing of a train of electric pulses, or it can be transmitted by modulating the frequency or amplitude of the pulsating signal. More than one transducer or other device may be employed in the system, in which case a multiplexer may be used for sending the various signals over a single conductor.

The present invention contemplates maintaining a portion of the cable 22 in tension. As schematically illustrated in FIG. 1, the cable 22 extends from instrument 21 around upper and lower cable guide assemblies 23 and 24 disposed in the drill string 12, and to the surface where it connects to kelly cable 25. In this embodiment, the kelly cable 25 extends through the kelly 11 and connects to a terminal located at the upper end of the kelly 11. It should be observed, however, that cable 25 may be embedded in the kelly 11, in which case the cable 22 will extend to the upper end of the drill string 12 and connect to kelly cable 25 at that location. In order to facilitate the addition of pipe sections to the drill string 12, however, it is preferred that the kelly cable 25 extend through the interior of the kelly 11 and have a tail portion 31 which extends slightly more than the length of one pipe section below the lower end of kelly 11. This arrangement is illustrated and discussed in length in U.S. Pat. No. 3,825,078.

If telemetry operations are to be performed while the kelly 11 and drill string 12 are rotating, the upper end of the kelly cable 25 will be connected to a device 26 capable of transmitting electric energy from a rotating member to a stationary member. Device 26 may be a rotary transformer having a rotor secured to the kelly 11 and a stator secured to the stationary portion of the swivel 10, or it may be a slipring and brush assembly. Device 26 and electric conductor 27 provide means for transmitting signals from the cable 22 within the pipe string to receiver 28. The return path for the electric circuit may be provided by a variety of grounding circuits but preferably is through the pipe string or conductor armor. Conductor 29, part of the return path, interconnects stationary portion of device 26 and receiver 28. If telemetry operations are to be performed at times when the drill string 12 and kelly 11 are stationary, device 26 will not be needed and the conductors 27 and 29 may be connected directly to cable 22 and ground through a suitable connector. In this situation, conductors 27 and 29 will be disconnected when the kelly 11 and drill string 12 are in use. Other means for transmitting the signal to the receiver 28 include a wireless transmitter connected to cables 22 or 25 and located on a rotating member, e.g. kelly 11.

The receiver 28 is an instrument capable of receiving the signal generated by instrument 21 and reducing it to useful form.

As mentioned previously, the apparatus for maintaining the cable 22 in the overlapped configuration includes an upper cable guide assembly 23 and a lower cable guide assembly 24. The cable 22 at its lower terminal end is provided with a connector 33 for attachment to the instrument 32. The cable 22 extends from the instrument upwardly to and around the upper guide assembly 23, down to and around the lower guide assembly 24, and upwardly to the surface where its upper terminal end is provided with a connector 34 adapted to mate with a connector 35 on the kelly cable 25. This arrangement provides the cable with three overlapped portions 36, 37, and 38.

As will be described in more detail below, the upper guide assembly 23 is mounted on the pipe string 12 and the lower guide assembly 24 is supported on a looped portion of the cable 22. The lower guide assembly 24 is provided with a weight 32 to maintain overlapped cable portions 37 and 38 in tension. Thus, as the cable 22 at the surface is withdrawn or as additional cable is introduced, the lower guide assembly 24 is free to move up or down within the pipe string 12.

With the telemetry equipment arranged as illustrated "logging while drilling" operations may be conducted. A transducer or other sensing element 30 may be mounted in sub 42 and disposed to detect a condition, e.g. pressure, temperature, or mud property, in wellbore 17. The measured intelligence is converted to an electric signal in instrument 21 and transmitted via conductors 22, 25, 27 to receiver 28 which converts the intelligence to useful engineering units. The telemetry operations may be performed as drilling is in progress. The drill string 12 and downhole telemetry equipment including cable 22 and guide assemblies 23 and 24 are turned as a unit at drilling rotational speeds which range between about 50 and 200 r.p.m.

When it becomes necessary to lengthen the drill string 12, telemetry and drilling operations are momentarily interrupted and a pipe section is introduced into the drill string 12 by the following procedure. The drill string 12 is suspended in the rotary table 16; kelly 11 is disconnected from the drilling string 12 and elevated until connectors 34 and 35 are withdrawn. This raises the lower guide assembly 24, and shortens the lengths of overlapped portions 36, 37, 38. Connectors 34 and 35 are separated and with connector 34 supported on the upper end of the drill string 12, the tail portion 31 of kelly cable 25 is threaded through the pipe section to be added. The kelly 11 is then connected to the upper end of the additional pipe section. This assembly is elevated above the pipe string 12. After reconnecting the connectors 34 and 35, the additional pipe section is screwed into the drilling string 12 placing the equipment in condition to resume drilling and telemetry operations.

The overlapped cable configuration thus stores excess lengths of conductor within the pipe string 12. The amount of excess cable is equal to the combined length of overlapped cable portions 37 and 38. The excess cable is used up in increments as each additional pipe section is added. When the excess lengths of conductor are used up, as when the lower guide assembly 24 reaches upper guide assembly 23, the conductor system normally will be withdrawn from the drill string.

In order for the telemetry system to operate for long intervals, it is desirable to store as much conductor as possible in the pipe string which results in long lengths of cable portions 37 and 38. Experience with this type of system has shown that long lengths of overlapped cable tend to become entangled, due to rotational action of the pipe string on the free handing lower guide assembly 24.

It has been found that if the cable section 36 (which extends from the instrument 21 to the upper guide assembly 23) is maintained in tension, the entanglement tendency of the cable is substantially reduced. It should be noted that the weight 32 in many applications is incapable of maintaining the cable portion 36 in tension because of space restriction within the drill string 12. For example, to maintain a cable portion 36 having a length of 15,000 feet in tension, would require a weight of about 1500 pounds, or about 275 feet of 2 inch steel rod.

The present invention provides means on the upper guide assembly 23 for maintaining the cable portion 36 in tension. Preferably, the means for performing this function is in the form of a cable gripping device 40 which permits the cable to be moved upwardly in relation to the guide 23 but prevents movement in the opposite direction. Thus, when the assembly is supported on the drill string 12, the desired amount of tension can be applied to the cable 22; and, as a result of the cable gripping device 40, the tension is maintained throughout cable portion 36.

In order to apply sufficient tension on the cable portion 36, the instrument 21 must be anchored within the drill string 12. The instrument 21 may be retrievably mounted in the drill string 12 by latching means which permit the instrument to be lowered into the drill string and latched in place. In a preferred embodiment, however, the instrument 21 is non-retrievably mounted in a suitable sub 41 above sub 42. In this embodiment, the cable 22 is provided with a lower connector 33 which can be engaged and disengaged from the instrument 21. However, since the engagement should be attainable by the application of very little downward force and yet be sufficiently strong to maintain the engaged position upon the application of the desired amount of tension, the connector 33 has been designed to (1) permit engagement by gravity alone, (2) hold a pulling force necessary to tension the cable, and (3) be releasable upon the application of a predetermined force which is somewhat larger than the force to maintain cable portion 36 in tension.

Briefly, the telemetry system is installed by first placing in the borehole 17 the drill string 12 including subs 41 and 42; lowering the cable 22, provided with lower connector 33, within the drill string 12; and engaging connector 33 to instrument 21, which not only provides electrical contact therewith but also anchors the cable 22 thereto. The cable 22 is then reaved around the upper guide assembly 23 which includes the cable gripping device 40, and around the lower guide assembly 24. With the cable system in the drill string 12, a force is pulled on the cable 22 placing the entire cable including portion 36 in tension. When this pulling force is released, the cable gripping device 40 maintains the tension on cable portion 36. The telemetry and drilling equipment are connected permitting "logging while drilling" operation to be carried out. As drilling proceeds and as additional pipe sections are required, each pipe section may be introduced into the pipe string as needed and the overlapped sections pulled upwardly through the added pipe sections in the manner described previously. This process may be continued until the excess cable is used up which will occur when the lower guide assembly 24 reaches the upper guide assembly 23. At that time, the cable 22 may be withdrawn by pulling an upward force at the surface. Initially the spider which mounts the upper guide assembly 23 in the drill string 12 is released and, when a predetermined cable tension is reached, the connector 33 disengages from the instrument 21, permitting the entire assembly to be retrieved.

Figure 2:
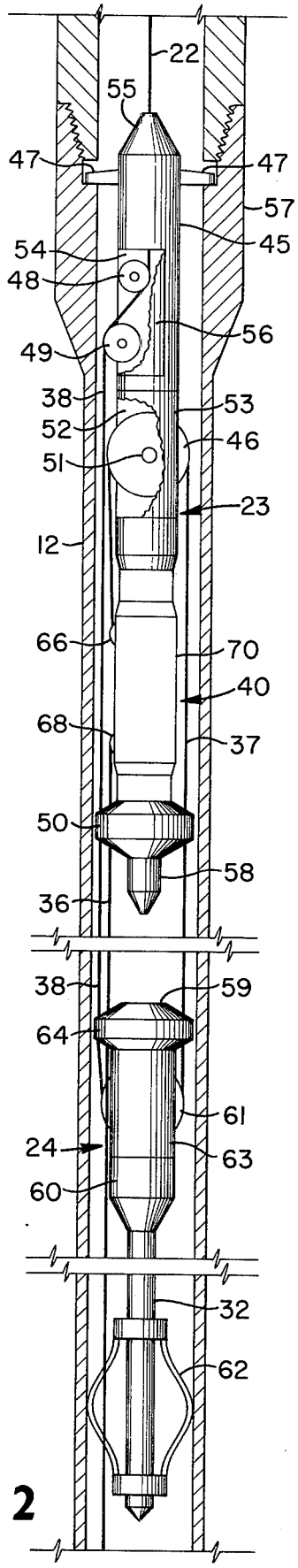
FIG. 2 is a sectional, side elevational view of apparatus constructed according to the present invention and usable in wellbore telemetry operations.

As best seen in FIG. 2, the upper guide assembly 23 comprises an elongated body 45, a sheave 46 journaled to body 45, support arms 47, and guide rollers 48 and 49. The sheave 46 is mounted for free-wheel rotation on shaft 51 and is disposed within opening 52 formed in the body 45. The outer side of the opening 52 is closed by panel 53 (shown cutaway in FIG. 2).

The sheave 46 has a grooved outer periphery for retaining cable 22. Its pitch diameter is sufficiently small to fit within the drill string 12 but large enough to permit the cable 22 to be bent therearound without kinking. The rollers 48 and 49 are mounted for free-wheel rotation in an opening 54 formed in body 45 at a location above the sheave opening 52 but angularly offset therefrom. Opening 54 is closed on one side by panel 56 (shown cutaway in FIG. 2). Panels 53 and 56 are secured to body 45 by fasteners such as screws but are removable therefrom to permit the cable 22 to be properly placed on the guide assembly 23.

The support arms 47 pivotally mounted in the upper extremity of the body 45 in combination form a spider for supporting the guide assembly 23 on the drill string 12. In the supporting position, the arms 47 extend radially ourwardly as illustrated and rest on the box end 57 of a drill pipe section. The arms 47, however, are pivotable downwardly into suitable slots formed in the body 45 to permit the assembly to be retrieved from the drill string 12 if desired. A central opening extends from opening 54 through the upper nose end 55 of the body 45. A side opening slot (not shown) provides access to the nose opening permitting the cable 22 to be placed therein. As described in more detail below (with reference to FIG. 3) the upper guide assembly 23 also includes a cable gripper device 40.

The lower guide assembly 24 includes body 60, sheave 61 journalled for free-wheel rotation on the body 60, and weight 32, which may be provided with a centralizer 62. The sheave 61 is mounted on the body 60 in an opening which is closed on one side by removable panel 63.

The lower end of body 45 is tapered to mate with a complementary-shaped concave upper end 59 of body 60. Cable guides 50 and 64 are also provided near the lower end of body 45 and upper end of body 60, respectively. The guides 50 and 64 are each provided with three cable openings. The openings are aligned so that as the bodies 45 and 60 are drawn together, the two bodies are guided into mating engagement. Moreover, since cable 36 is maintained in tension in the practice of this invention, guide assembly 24 can move up and down with respect to cable 36 with relative ease since the cable will be relatively free of twists and snares.

The cable 22 extends (from top to bottom) through the nose end 55 of body 45, between guide rollers 48 and 49, through guides 50 and 64, down and around sheave 61, back through guides 50 and 64, up and around sheave 46, down through the cable gripping device 40, through guides 50 and 64, and finally down to the instrument 21 anchored in the drill string 12. The overlapped cable portions provided by the guide assemblies 23 and 24 are designated by the same reference numerals (36, 37, and 38) schematically illustrated in FIG. 1.

As mentioned previously, the lower guide assembly 24 is suspended on a looped portion, e.g. portions 37 and 38, of the cable 22 and is movable within the pipe string 12 by the introduction or withdrawal of cable at the surface. The cable gripping device 40 prevents slack from being introduced into the cable portion 36.

Figure 3:
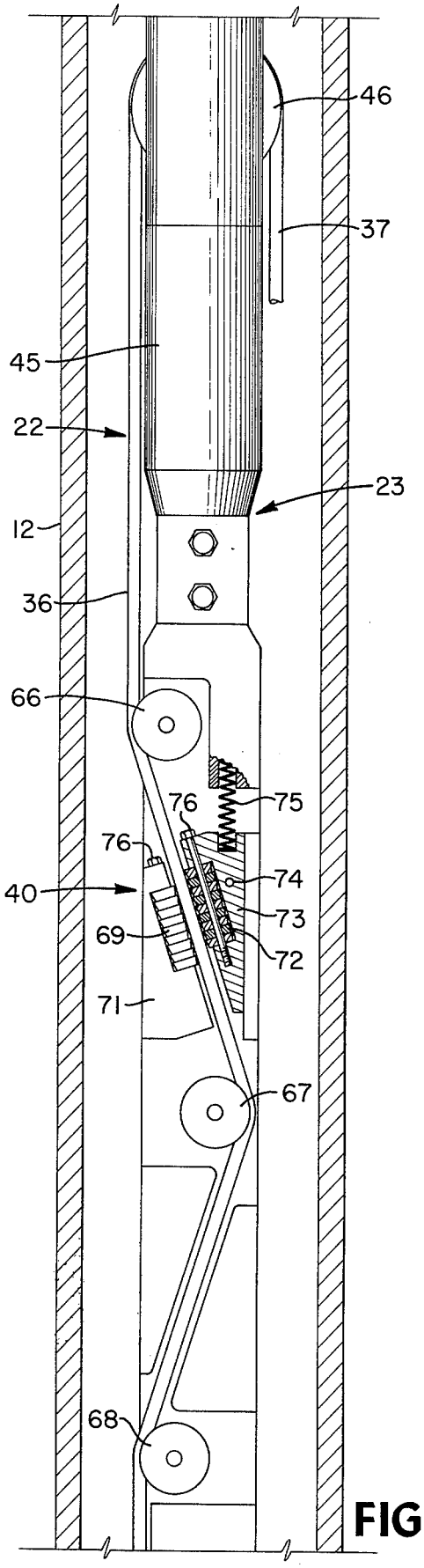
FIG. 3 is an enlarged view of the apparatus shown in FIG. 2 with portions cut away, illustrating details of the cable gripping device.

As shown in detail in FIG. 3, device 40 includes guide rollers 66, 67 and 68 journalled for free-wheel rotation on body 45, and opposed cable gripping members 69 and 72. The gripping members may take a variety of forms and shapes. In this embodiment the gripping members are in the form of aligned teeth adapted to engage the cable at a plurality of points. One set of teeth, e.g. gripping member 69, is mounted on holder 71 which is secured to body 45. The other set of teeth, e.g. gripping member 72 is mounted on a holder 73 movable along body 45 between a cable gripping position and a release position. Holder 73 is slidable within suitable track to permit longitudinal rectilinear movement. The track may include side plates and rails suitably slotted for receiving guide pin 74.

A compression spring 75 urges the member 72 downwardly into the normal cable gripping position in relation to member 69. The teeth of members 69 and 72 are individual members arranged in stacked relation and are maintained on their respective holders by central bolts 76. It is preferred that the teeth or at least the portion that engages the cable be constructed of hard metal such as tungsten carbide to prevent excessive abrasion. The teeth in this embodiment are arranged to present straight transverse edges for engaging the cable at a plurality of points. The cable 22 is installed in the cable gripping device 40 by reaving the cable over guide roller 66 and with movable teeth assembly 72 depressed, the cable is placed between the opposed teeth, and finally reaved about guide rollers 67 and 68. Rollers 66 and 67 are aligned to maintain the portion of cable therebetween parallel to aligned sets of teeth. Spring 75 urges teeth 72 into gripping the conductor disposed between teeth 69 and 72. The teeth are tapered such that the gripping force prevents downwards movement of the conductor. Upward movement of the cable 22 forces the movable teeth 72 upwardly against the bias force of spring 75 permitting the cable to move up through the device 40. However, as soon as the external force is released, the teeth 72 immediately return to their holding position preventing downward movement of the cable 22. Downward pulling force exerted by the cable portion 36 in tension, increases the gripping force of teeth 72 and teeth 69.

The spring 75 need not be strong since it merely provides a small biasing force to maintain the movable teeth assembly in the gripping position. The parts making up device 40 are enclosed on one side by a side enclosure panel 70 (see FIG. 2).

As mentioned previously, the connector 33 for connecting and anchoring the cable 22 to the instrument 21 should be designed to permit easy connection, withstand a minimum tension, and be releasable by a predetermined tension in the cable portion 36.

As shown in FIG. 1, the instrument 21 is mounted in a suitable sub 41 which in turn is mounted immediately above the sub 42 provided with external probes (one shown as 30) in communication with the borehole 17. The instrument 21 is mounted in a suitable shock absorbing support such as upper and lower mounting members 77 and 78. The mounting members 77 and 78 may be provided by resilient rubber contained in metal sleeves. The metal sleeves may be secured to the sub by a suitable fastener such as circumferentially spaced threaded pins.

In order to permit the circulation of fluid through the drill string and past the instrument 21, the mounting members 77 and 78 are provided with large flow openings.

Figure 5:
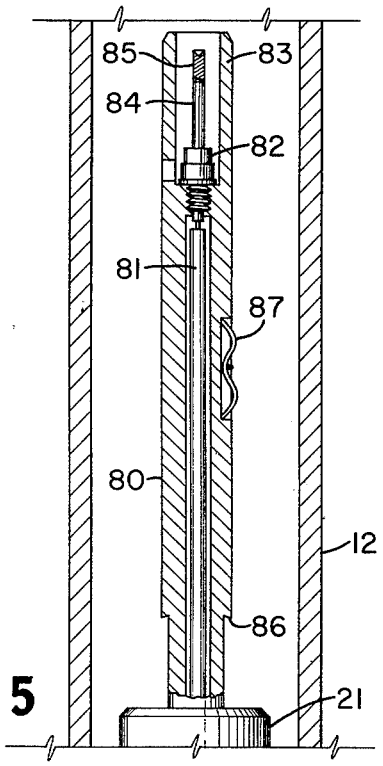

Secured to the upper end of instrument 21 is an upwardly projecting tube 80 (see FIG. 5) having a diameter substantially less than that of the instrument 21. A conductor 81 extends from the interior of the instrument 21 up through the tube 80 terminating at connector 82 secured to the counterbored upper end 83 of the tube 80. As described in more detail below, the connector 82 has an upwardly projecting pin 84, the tip 85 of which constitutes the connector contact. The lower portions of the pin 84 are made of insulating material, and conductor wire passes through the center of pin 84 and electrically connects contact 85 and conductor 81.

The tube 80 is made of high strength material such as steel and is secured as by a threaded connection to instrument 21. A lower section of the tube 80 is narrowed to provide a circumferential, downwardly facing shoulder 86. Shoulder 86 is adapted to receive the latching means of connector 33. A leaf spring 87 mounted in a suitable side slot in the tube 80 extends slightly beyond its outer periphery and, as described below, provides an electric contact for the grounding circuit.

Figure 4:
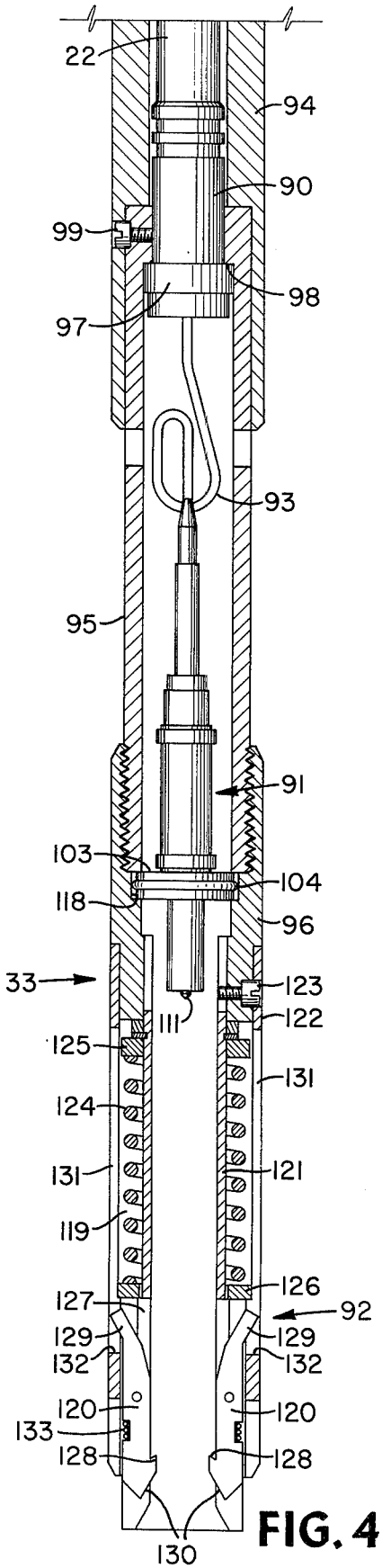
FIGS. 4 and 5 are longitudinal sectional views of mating members of a cable connector constructed according to the present invention, shown in the disconnected position.

As best seen in FIG. 4, connector 33 comprises three main parts: (1) a cable head 90, (2) a contact member 91, (3) and a latching mechanism 92. The strands of the outer steel sheath of the cable 22 are anchored to the connector housing by the cable head 90. The conductor wire extends through the head 90 and is electrically connected to flexible cable wire 93 which in turn is connected to the contact member 91. The cable head 90 and contact member 91 are housed within mounting sleeves 94 and 95 and fitting 96. The head 90 has an outer flange 97 adapted to engage an internal shoulder 98 of sleeve 95 such that stress applied on cable 22 is transmitted through the head 90 to the connector housing. A set screw 99 maintains telescoping end portions of sleeves 94 and 95 together and also retains head 90.

Figure 7:
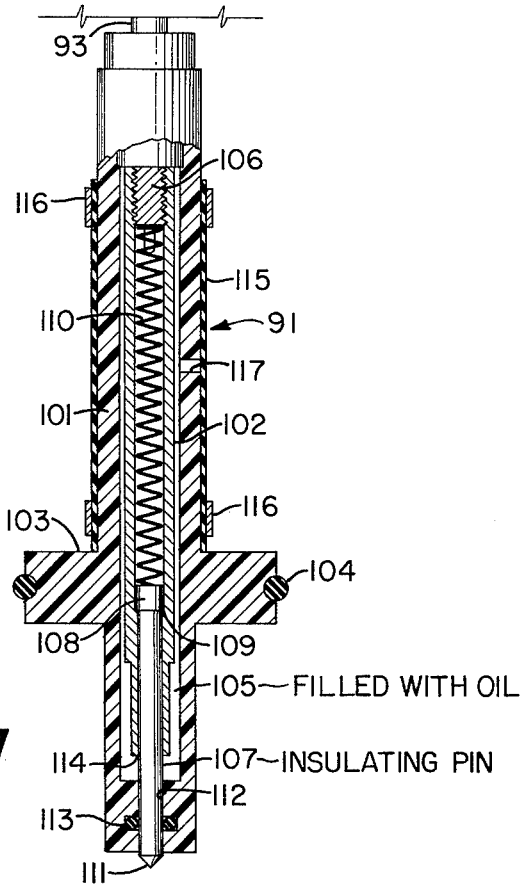
FIG. 7 is an enlarged sectional view of a portion of the connector shown in FIG. 4.

Details of the contact member 91 are described below with reference to FIG. 7. The body 101 made of insulating material, such as molded rubber or plastic, houses an elongated contact element 102. An intermediate portion of the body 101 is provided with a flange 103 which carries at its outer periphery resilient O-ring 104. The body 101 encloses an inner chamber 105 in which is mounted the electric contact element 102. In a preferred embodiment, the element 102 is a brass tube. One end of the tube is threaded to a plug 106 which is electrically connected to the flexible conductor 93. The lower open end 114 of the tube constitutes a female contact sized to receive male contact 85. This end may be slightly crimped to provide an interference fit on the contact 85. A pin 107 made of insulating material such as ceramic or rigid plastic is mounted within contact 102. Spring 110 urges the head end 108 of pin 107 into engagement with internal shoulder 109 formed in tube 102. The pin 107 is sized to slide within tube 102 and has a convex tip 111 complementary to the concave tip of contact 85.

In its normal position, the pin 107 closes a lower opening 112 formed in the body 101 and exposes tip 111 externally of the body 101. An O-ring 113 provides a seal for the pin 107 within opening 112.

The chamber 105 is filled with oil. In order to permit reductions in the volume of oil within chamber 105 as for example when pin 107 is depressed, a rubber expansion sleeve 115 is mounted to the exterior of body 101 by clamps 116. A port 117 communicates with chamber 105.

The contact member 91 is mounted within cylindrical chamber 118 in fitting 96 with the pin 107 projecting downwardly. The diameter of chamber 118 is slightly smaller than the OD of O-ring 104. This permits the contact member 91 to be snugly retained in fitting 96 and yet permit slight rocking movement. Sleeve 95 screws into the upper end of fitting 96 and serves to maintain the flange 103 in place.

The latching mechanism 92 includes a plurality of latching arms 120 mounted at the lower end of tube 121. Three or four arms 120 circumferentially spaced about tube provide means for latching onto instrument tube 80. The tube 121 and sleeve 122 are concentrically arranged defining spring compartment 119.

The upper end of sleeve 122 telescopes over the lower end of fitting 96. These parts are maintained in assembled relation by set screws, one shown as 123.

Spring 124 mounted in compartment 119 and acting through ring 125 secured to the exterior of tube 121 and ring 126 secured to the interior of sleeve 122 urges the upper end of tube 121 into engagement with the lower end of fitting 96. The tube 121 and latching arms 120 are thus axially movable against the bias of spring 124. The lower end of the tube 121 extends downwardly below the spring compartment 119. Slots 127 formed in the lower end of tube 121 receive the latching arms 120. Each arm 120 is pivotably mounted within a slot 127 and has a tapered gripping jaw 128 which protrudes within the interior of tube 121. The upper end of the arm tapers outwardly presenting a trip lug 129. A spring 133 wound about the tube 121 and arms 120 maintains the arms 120 in the latching position illustrated in FIG. 4. Formed in the lower ends of the latching arms are tapered edges 130 which upon being contacted by a subsurface tool depress the arms within slots 127 to the disengaged position.

The sleeve 122 is provided with longitudinal slots 131, one slot for each latching arm 120. The sleeve 122 and tube 121 are assembled such that each trip lug 129 of arm 120 is disposed near the lower end of its associated slot 131. Each lug 129 thus is disposed in the path of the lower edge 132 of each slot 131.

The structure of the connector 33 described above permits (1) anchoring of the cable 22, (2) establishing electrical continuity from the instrument 21 to the conductor 22, and (3) disconnecting the connector 33 from the instrument 21. These separate functions are described below in connection with telemetry operations. However, it should be emphasized that the novel connector has other applications. The connector can be used in other drilling operations or subsea operations.

The cable 22 usable in the preferred embodiment of the present invention should have the following properties. It should have a breaking strength sufficiently high to support the guides 23 and 24 and bear tensile stress up to several hundred pounds; it should have an operating temperature at least equal to the maximum subsurface temperature encountered; and it should be sufficiently flexible to permit it to be arranged in the proper convoluted configuration. A particularly suitable conductor is a single conductor 3/16-inch armored cable manufactured by Vector Cable Company and sold as Type 1-18P. Tests have shown that this cable can be bent around sheaves having a pitch diameter of two inches and is sufficiently strong for use in the present invention.

Both the upper and lower assemblies with cable wound thereon should have a sufficiently small diameter to pass through the interior of a drill string. For a 4-½ inch drill pipe with internal upset I.D. of 2.81 inches, 2 inch sheaves and somewhat smaller body diameters provide adequate clearance.

When it is desired to begin telemetry operations, the drill string 12 equipped with the special subs 41 and 42 are lowered into the borehole 17 and positioned slightly more than one pipe joint above the bottom of the borehole 17. In this position, the instrument 21 is located at the bottom of the drill string 12 and presents upwardly projecting tube 80 and pin 84.

The cable 22 provided with connector 33 is lowered into the drill string 12. Note that the connector 33 is sufficiently heavy to gravitate within the mud filled drill string 12. Sinker bars may be added to the cable to provide additional weight if needed.

Figure 6:
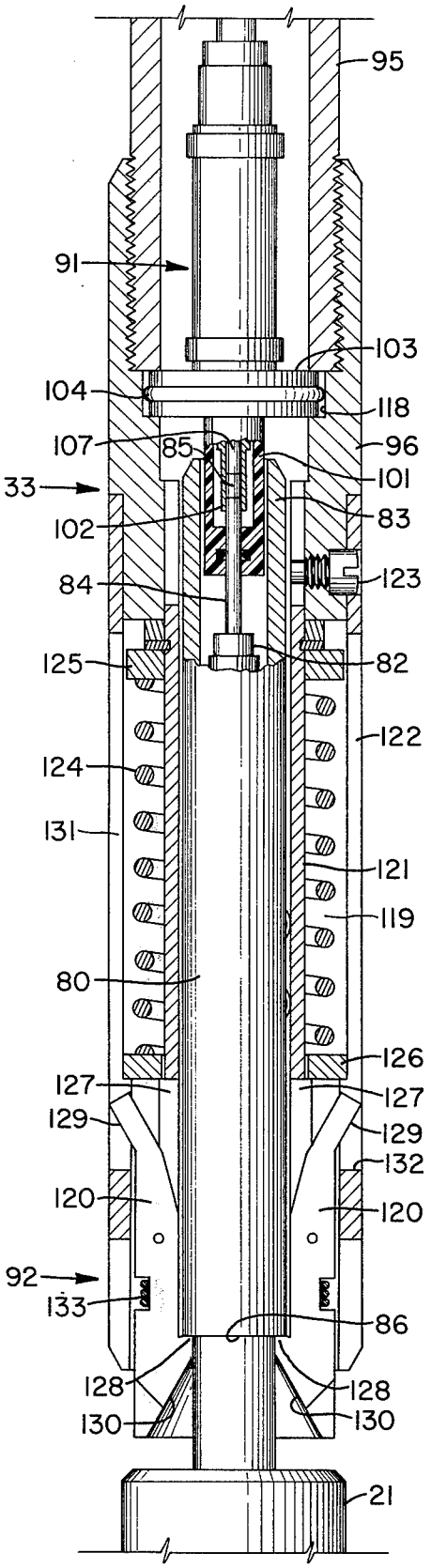
FIG. 6 is an enlarged view of the members shown in FIGS. 4 and 5 shown in the connected position.

As the connector 33 approaches instrument 21, tube 80 enters tube 121 forcing the latching jaws 128 of latching arms 120 outwardly. The ends of the tubes 80 and 121 are complementary tapered to guide the former into the latter. Further downward movement of the connector 33 brings the pin 84 into engagement with pin 107. The complementary tips of those two members ensure proper alignment. Further downward movement depresses pin 107 within contact tube 102 until male contact 85 mates with female contact 114. This completes the electrical circuit across the connector 33. The return path is provided through the connector body. Spring 87 engages the interior of tube 121 to insure good contact. At the same time the downward movement of connector 33 causes the gripping jaws 128 to latch onto shoulder 86. This anchors the lower end of the cable 22 to the instrument 21 (FIG. 6 shows the connector 33 latched onto and electrically connected to instrument tube 80). The stress bearing components of the connector 33 comprise housing members 94, 95, 96, sleeve 122, tube 121, and arms 120.

The cable 22 is then positioned on the upper and lower guide assemblies 23 and 24. These assemblies are introduced into the drill string 12. The support arms 47 are placed on the supporting shoulder of the box end 57 of the top pipe joint. The cable 22 thus extends from instrument 21 up to and around the top sheave 46, down and through the cable gripping device 40, down and around the bottom sheave 61, up and through the nose end 55 of body 45.

In order to apply tension in the entire spool of cable portion 36, a force is pulled on the cable 22 at the surface. This may be achieved by reeling excess conductor on a cable drum. The lower guide assembly 24 is raised until its upper end 59 mates with the lower end 58 of guide assembly 23. Additional force tightens the cable 22 around the various sheaves and guide rollers and applies a tensile force on cable portion 36.

The force required will vary. As a general rule, however, the force applied will be from about 50 to 100 pounds at the connector 33. Of course, the force pulled at the surface will be substantially more than this value because of the weight of the cable portion 36. As described previously, the cable gripping device 40 prevents downward cable slippage and thereby maintains the tension force applied on cable portion 36.

The bias of spring 124 should be sufficient to permit the desired tension to be placed on cable portion 36 without disengagement of connector 33 from instrument 21. However, this bias should not be so great as to place excessive strain on cable 22 or the elements of connector 33 when disengagement is desired. Generally, the bias should be such that connector 33 will disengage when a force of several hundred pounds is placed on connector 33 by means of cable 22 but will not disengage below that level.

After the cable is properly tensioned, additional cable 22 is unreeled and introduced into the drill string 12. This lowers the lower guide assembly 24 within the drill string 12 forming long overlapped portions 37 and 38 which as noted above constitute stored cable. When the proper amount of cable has been introduced into the drill string 12, a connector 34 is connected to its upper terminal end. This connector 34 and drill string are then connected to the kelly cable 25 and kelly 11, respectively, placing the system in condition to commence drilling and telemetry operations.

Intelligence from the instrument 21 is transmitted through conductors 22, 25 and 27 to receiver 28. The drill string 12 is periodically lengthened by the addition of pipe sections and the cable 22 is lengthened the same amount by withdrawing stored cable. This procedure may continue until the stored cable has been used up, which occurs when the lower guide assembly 24 engages the upper guide assembly 23. Excess cable may be restored by introducing additional cable to the drill string 12. This lowers the lower guide assembly 24 within the pipe string 12. Alternatively, the cable system may be retrieved. With the drill string 12 suspended in the rotary table 16 and with the kelly 11 and kelly cable 25 disconnected from the drill string 12 and cable 22, a force is pulled on cable 22. This engages the lower guide assembly 24 with the upper guide assembly 23. The application of a pulling force then is transmitted to connector 33 via cable 22. When the pulling force exceeds the bias force of spring 124, sleeve 122 of connector 33 moves upwardly with respect to tube 121. Slot edges 132 of the sleeve 122 engage the trip lugs 129 causing the gripping jaws 128 of arms 120 to move out of latching engagement with shoulder 86 of tube 80. This disengages connector 33 from instrument 21 permitting the cable 22 and guide assemblies 23 and 24 to be withdrawn.

The following illustrates one specific embodiment of the present invention designed for use in 4-½ inch drill pipe having inside diameter of 2-¾ inches. (The system is similar to that illustrated in FIGS. 2–7)

| UPPER GUIDE ASSEMBLY (23) | |
|---|---|
| Body (45) | |
| Material | Steel |
| Outside diameter | 2 inches |
| Length | 5 feet |
| Sheave (46) | |
| Material | Steel |
| Pitch Diameter | 2-1/4 inches |
| Cable Gripping Device (40) | |
| No. of teeth (72) | 9 |
| No. of teeth (69) | 9 |
| Material | Tungsten Carbide |
| Size | 1/8" × 3/8" × 3/8" |
| Diameter of each roller (66, 67, 68) | 1 inch |
| LOWER GUIDE ASSEMBLY (24) | |
| Body (60) | |
| Material | Steel |
| Outside Diameter | 2 inches |
| Length | 2 feet |
| Weight (32) | |
| Material | Steel |
| Outside Diameter | 1-7/16 inches |
| Length | 5 feet |
| Weight | 80 pounds |
| Sheave (61) | |
| Material | Steel |
| Pitch Diameter | 2-1/4 inches |
| CONNECTOR (33) | |
| Outside Diameter | 2-1/7 inches |
| Inside Diameter of tube 121 | 15/16 inches |
| Length | 3 feet |
| Weight | 60 pounds |
| Spring (124) | |
| Length | 3-1/2 inches |
| Diameter O.D. | 1-3/4 inches |
| I.D. | 1-1/8 inches |
| Force rating | 800 pounds per inch |
| Preload force | 300 pounds |

The system may be used with a 3/16-inch armored cable. It is contemplated that the connector 33 will latch onto the downhole tool by gravity alone and will permit a tension force of up to 600 pounds to be applied to the cable.

The cable system may be retrieved from the drill string by gradually increasing a pulling force on the cable at the surface. The latch will be released when the force at the connector reaches about 600 pounds.

Although the present invention has been described with reference to conventional rotary drilling operations, it can also be used with other types of drilling equipment including turbodrills and positive displacement hydraulic motors. These devices normally include a motor or turbine mounted on the lower end of the drill string and adapted to connect to and drive a bit. The motor or turbine powered by the drilling fluid drives the drill bit while the drill string remains stationary. When this type subsurface drilling device is used in directional drilling operations, the present invention provides a highly useful means for transmitting directional data to the surface.

We claim:

1. In a cable mounting method wherein an electric cable extends from a subsurface location within a rotary pipe string to an upper guide assembly, from said upper guide assembly downwardly to a lower guide assembly, and from said lower guide assembly upwardly to the surface, the improvement comprising anchoring said cable at said subsurface location and maintaining the cable portion between said subsurface location and said upper guide assembly in tension.

2. A method as defined in claim 1 and further including the steps of supporting said upper guide assembly on said pipe string and supporting said lower guide assembly on a looped portion of the cable.

3. A method as defined in claim 1 and further including the step of detachably mounting said cable at said subsurface location.

4. In a method for maintaining electrical continuity in a drill string which includes placing in said drill string a cable to form a first portion which extends from a subsurface location up to and around a guide supported on said drill string, a second portion which extends from said guide downwardly to a lower loop, and a third portion which extends from the lower loop substantially to the surface; adding a pipe section to said drill string; and threading an upper end portion of said third portion through said pipe section, said overlapped second and third portions providing excess cable permitting upward movement of said third portion, the improvement which comprises anchoring said cable at said subsurface location and gripping said cable at said guide to maintain said first portion in tension.

5. A method of mounting an electrical cable in a rotary pipe string to provide an electric circuit between a subsurface and surface location and to store cable in said pipe string, which comprises:

lowering a cable in said pipe string;

anchoring the lower end of said cable at said subsurface location in said pipe string;

reaving said cable about upper and lower guides;

supporting said upper guide in said pipe string;

applying a pulling force on said cable to place the cable in the pipe string in tension;

maintaining the cable between said subsurface location and said upper guide assembly in tension;

introducing additional cable into said pipe string to lower said lower guide within said pipe string; and connecting the upper end of said cable to said surface location.

6. In a cable system for wellbore telemetry which includes a cable arranged in a pipe string to extend from a subsurface location in said pipe string to an upper guide assembly, from said upper guide assembly to a lower guide assembly, from said lower guide assembly to the surface, the improvement which comprises means for maintaining the portion of cable which extends from said subsurface location to said upper guide assembly in tension.

7. In a system as defined in claim 6 wherein said means for maintaining said portion of cable in tension includes means for anchoring the cable at said subsurface location, and a cable gripping device on said upper guide assembly, said cable gripping device being adapted to permit upward movement of said cable and to prevent downward movement of said cable with respect to said upper guide assembly.

8. In a system as defined in claim 7 wherein said cable gripping device includes opposed gripping elements adapted to grip said cable therebetween, said elements being normally positioned to grip said cable therebetween and being movable to release said cable attendant to upward movement of said cable.

9. A cable system for wellbore telemetry which includes a rotary pipe string;

a cable;

means for anchoring a lower end of said cable at a subsurface location in the rotary pipe string;

an upper guide assembly supported in said pipe string; and a lower guide assembly disposed in said pipe string below said upper guide assembly, said cable extending from said subsurface location up to said upper guide, around said upper guide, down to said lower guide assembly, around said lower guide, and upward to the surface, said upper guide assembly including a cable gripping device which permits the cable portion between said subsurface location and the upper guide assembly to move upwardly but prevents downward movement, whereby tension can be applied and maintained on said cable portion.

10. A system as defined in claim 9 wherein the cable gripping device includes opposed cable gripping elements having a gripping position for preventing downward movement of said cable portion and a release position permitting upward movement of said cable portion.

11. A system as defined in claim 10 wherein said cable gripping device includes means for biasing said cable gripping elements into said gripping position so that said cable gripping elements normally occupy the cable gripping position.

12. A system as defined in claim 9 wherein the cable anchoring means includes a subsurface latch-on member secured to said pipe string at said subsurface location, a connector mounted on said cable and having latching means adapted to engage said member, means for maintaining said latching means on said member permitting a predetermined tension to be applied to said cable portion; and means for releasing said latching means from said latch-on member.

13. A system as defined in claim 12 wherein said latching means includes latching jaws adapted to latch onto said latch-on member, and said means for releasing said latching means includes a spring loaded tripping member adapted to move said latching jaws to the release position when a predetermined force is applied to said cable.

14. A system as defined in claim 13 wherein said latching jaws latch onto said member by gravity.

* * * * *